US006898813B2

(12) United States Patent
Grothaus

(10) Patent No.: US 6,898,813 B2
(45) Date of Patent: May 31, 2005

(54) INNERSPRING ASSEMBLY

(75) Inventor: Wolfgang Grothaus, Bad Essen (DE)

(73) Assignee: AGRO Federkernproduktions GmbH, Bad Essen-Wittlage (DE)

( * ) Notice: Subject to any disclaimer, the term of this patent is extended or adjusted under 35 U.S.C. 154(b) by 0 days.

(21) Appl. No.: 10/279,219

(22) Filed: Oct. 24, 2002

(65) Prior Publication Data

US 2003/0074736 A1 Apr. 24, 2003

Related U.S. Application Data

(60) Provisional application No. 60/335,246, filed on Oct. 24, 2001.

(51) Int. Cl.[7] ..... A47C 27/04
(52) U.S. Cl. ..... 5/655.8; 5/716; 5/720
(58) Field of Search ..... 5/655.8, 716, 720, 5/727; 267/89–93, 10

(56) References Cited

U.S. PATENT DOCUMENTS 1,717,378 A * 6/1929 Gail ..... 5/721
6,122,787 A * 9/2000 Kao ..... 5/723
6,170,807 B1 * 1/2001 Eto ..... 267/103

FOREIGN PATENT DOCUMENTS

| | | |
|---|---|---|
| DE | 40 31 654 C2 | 4/1992 |
| EP | 0 154 076 B1 | 4/1990 |

* cited by examiner

*Primary Examiner*—Michael F. Trettel
*Assistant Examiner*—Fredrick Conley
(74) *Attorney, Agent, or Firm*—Henry M. Feiereisen; Ursula B. Day

(57) ABSTRACT

An innerspring assembly includes a first plurality of interconnected strings of pocketed first springs. A second plurality of strings of springs is provided and so incorporated in the innerspring assembly that at least one string of springs of the second plurality is placed between two neighboring strings of the first plurality of interconnected springs, wherein the second springs have a diameter which is smaller than a diameter of the first springs.

7 Claims, 2 Drawing Sheets

INNERSPRING ASSEMBLY

CROSS-REFERENCES TO RELATED APPLICATIONS

This application claims the benefit of prior filed provisional application, Application No. 60/335,246, filed Oct. 24, 2001, pursuant to 35 U.S.C. 119(e), the disclosure of which is incorporated herein by reference.

BACKGROUND OF THE INVENTION

The present invention relates, in general, to an innerspring assembly of strings of pocketed springs for use as resilient cores of mattresses, cushions, and the like.

Innerspring assemblies of this type, also known as pocketed spring cores, have typically a plurality of interconnected strings of coil springs of same diameter. The pocketed springs of neighboring strings are positioned adjacent to one another in touching relationship and interconnected in this position. This construction suffers shortcomings because of the provision of fairly large intermediate spaces which are in particular large, when the springs have a barrel shape. This applies also to those constructions in which the strings of springs are placed in staggered relationship. In these cases, the single springs of a string are placed at such distance to one another that the springs of neighboring strings of springs can be placed in these intermediate spaces to realize a nested disposition. An example of such an innerspring assembly is disclosed in German Pat. Publication No. DE 40 31 654 A12.

European Pat. No. EP 0 154 076 discloses an innerspring construction of adhered strings of pocketed barrel springs in which the springs are placed in touching relationship instead of a staggered relationship.

Common to all these conventional innerspring constructions is the insufficient comfort provided for a person because the innerspring construction is unable to sufficiently conform to the body shape of the person as a consequence of the relatively small number of springs so that the spot elasticity is slight.

It would therefore be desirable and advantageous to provide an improved innerspring assembly to obviate prior art shortcomings and to realize a better resting comfort in a simple and cost-efficient manner.

SUMMARY OF THE INVENTION

According to one aspect of the present invention, an innerspring assembly, includes a first plurality of interconnected strings of pocketed first springs, and a second plurality of strings of second springs so incorporated in the innerspring assembly that at least one string of springs of the second plurality of strings is placed between two neighboring strings of the first plurality of strings of springs, wherein the second springs have a diameter which is smaller than a diameter of the first springs.

The present invention resolves prior art problems by constructing the innerspring assembly in a way that the strings of springs of greater diameter are alternated with strings of springs of smaller diameter from layer to layer. As a consequence, the number of springs is increased, leading to a greater spot elasticity of the innerspring assembly. Moreover, the surface, i.e. the recumbent area, becomes more compact, so that lighter body parts will sink in less and the innerspring construction will conform better to the body contour of the person reposed upon a mattress employing such a spring assembly. The comfort for the reposed person is enhanced to provide a more relaxing and rejuvenating sleep. Muscular tension is prevented as experienced heretofore with conventional innerspring constructions in which the adjustment of the springs to conform to the person's body had been inadequate.

The improved comfort by an innerspring assembly according to the present invention is also realized by the interlacing relationship of the strings of springs because a greater number of connections is possible in view of the placement of smaller springs in the intermediate spaces of the neighboring strings of greater springs and their attachment to the neighboring greater springs, so that, basically, each small spring is connected to four great springs. In view of this connection, an intimate bond is created indirectly between the great springs of two parallel strings of springs.

According to another feature of the present invention, the strings of smaller springs may have a vertical dimension (or height), which is slightly less than a vertical dimension (or height) of the strings of greater springs. As a result, the comfort for a reposed person is optimized because the person can softly sink in due to the smaller reactive force of the greater and higher springs and subsequently is supported in an optimum manner by the recessed smaller springs and their high reactive force.

An alternating arrangement of higher and lower springs results in an improved progressiveness of the spring behavior.

According to another feature of the present invention, the difference in the vertical dimension between the greater and smaller springs may be approximately the same on both sides.

According to another feature of the present invention, several strings of smaller springs can be placed between two strings of greater springs in abutting relationship. Suitably, the strings of smaller springs are placed in staggered relationship so that all intermediate spaces are nearly filled out.

According to another feature of the present invention, the greater and/or smaller springs may each have predetermined regions of different convolutions. The provision of varying convolutions enhances the spring behavior of the innerspring constructions. It is also conceivable to configure the springs with varying wire diameter. By arranging different springs and/or different strings of springs over predetermined regions, zones of varying spring behavior can be realized. These zones can hereby be individually configured so that each person can best suit the innerspring construction to his or her needs.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
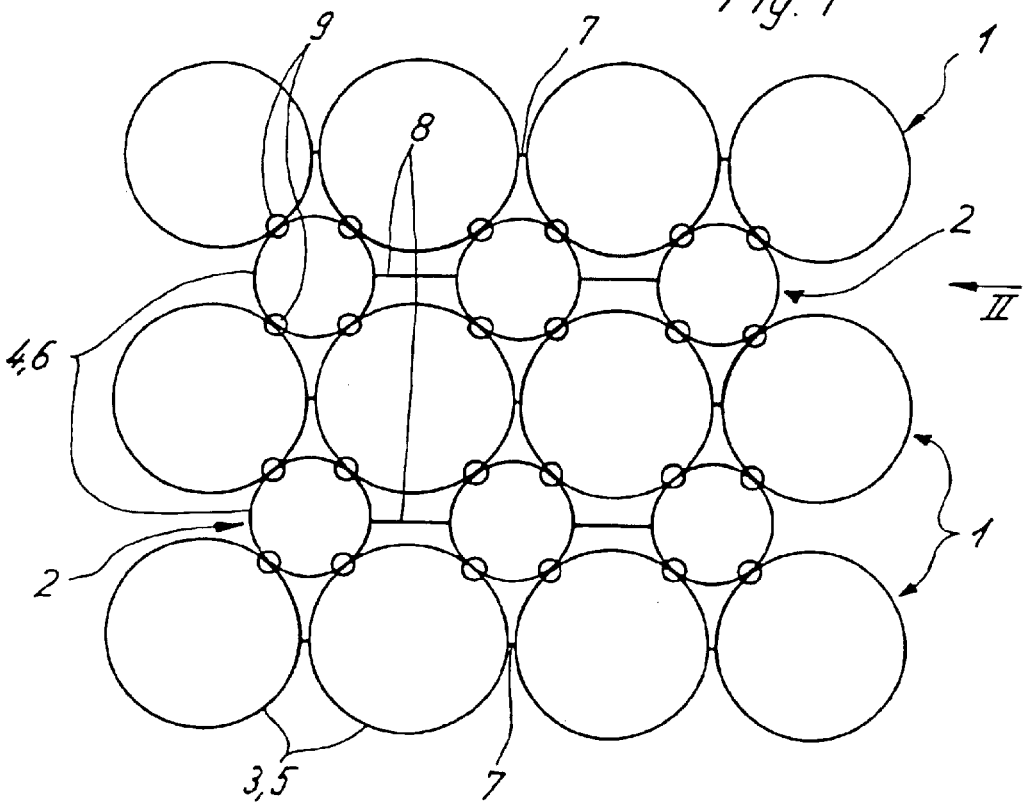
FIG. 1 is a fragmentary top plan view of one embodiment of an innerspring assembly according to the present invention.

Throughout all the Figures, same or corresponding elements are generally indicated by same reference numerals.

Turning now to the drawing, and in particular to FIG. 1, there is shown a top plan view of a portion of a first embodiment of an innerspring assembly according to the present invention, including a plurality of parallel strings 1 of springs 5 encased and restrained by pockets 3 of a textile fabric or the like. The springs 5 are configured here as barrel springs and have a same diameter. Placed between each two neighboring strings of springs 5 is a further string 2 of springs 6, whereby the springs 6 have a diameter which is smaller than the diameter of the springs 5. The springs 6 are encased and restrained by pockets 4 of a textile fabric or the like and are also configured here as barrel springs. Bridges 7 interconnect the pockets 3 of the strings 1 of springs 5, whereas the pockets 4 of the strings 2 of springs 6 are interconnected by bridges 8, so that the movement between neighboring strings is substantially independent, especially in axial direction.

The string 2 of smaller springs 6 is placed between the string 1 of greater springs 5 so that each smaller spring 6 of the string 2 is arranged in the intermediate space defined between four greater springs 5 and secured in touching relationship at attachment points 9 to the adjacent neighboring greater springs 5. As clearly shown in FIG. 1, the intermediate space between two strings 1 of springs 5 is substantially filled by the smaller spring 6, thereby realizing the afore-stated advantages.

Figure 2:
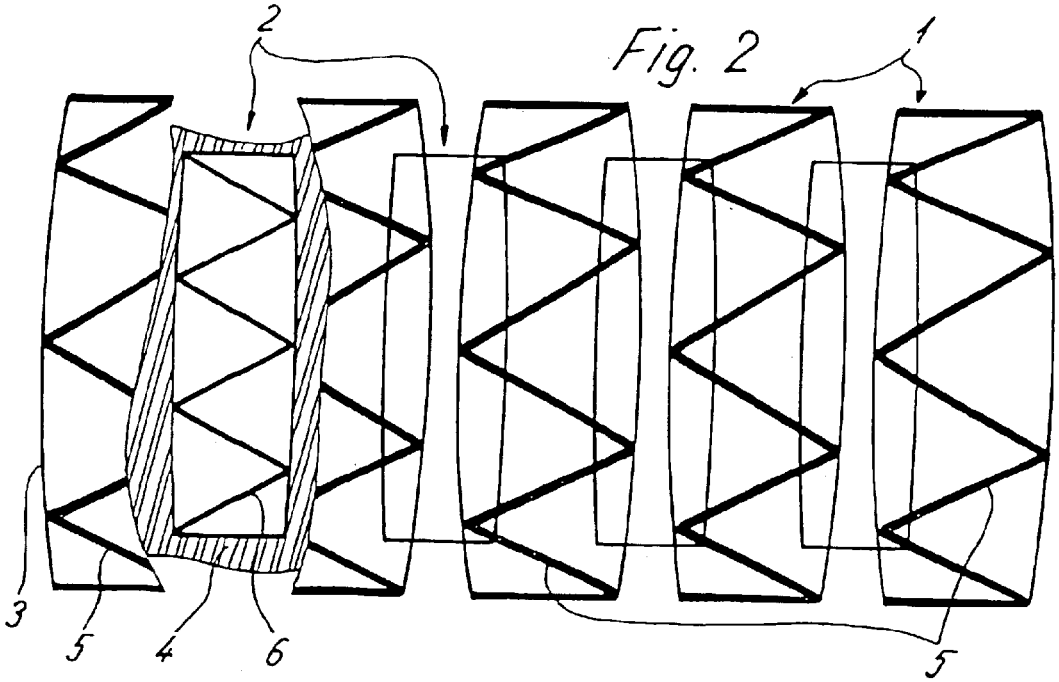
FIG. 2 is a schematic partly sectional side view of the innerspring assembly, as viewed in the direction of arrow 11 in FIG. 1.

FIG. 2 is a schematic partly sectional side view of the innerspring assembly, as viewed in the direction of arrow II in FIG. 1 and shows the greater springs 5 of the strings 1 with greater vertical dimension or height than the smaller springs 6 of the strings 2, whereby the respective distance in height to the neighboring greater springs 5 is approximately the same on both sides of the smaller springs 6. The difference in height of the springs 5, 6 is freely selectable and dependent on the user's wishes and needs.

Figure 3:
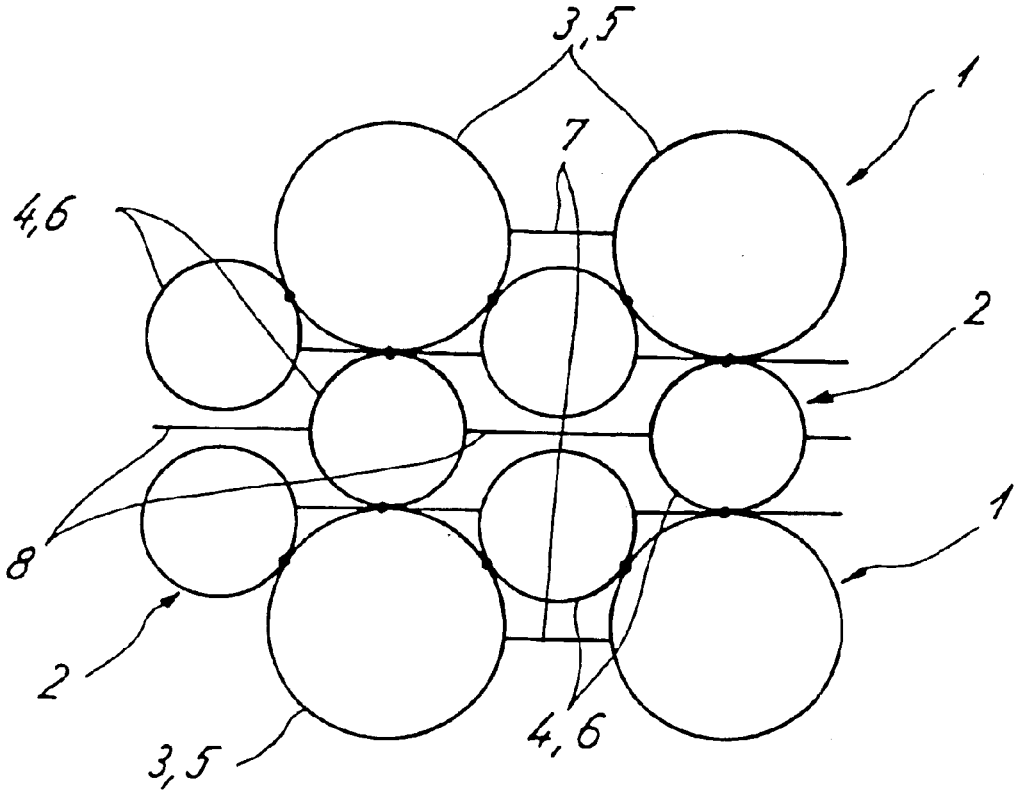
FIG. 3 is a fragmentary top plan view of another embodiment of an innerspring assembly according to the present invention.

FIG. 3 shows a fragmentary top plan view of another embodiment of an innerspring assembly according to the present invention. Parts corresponding with those in FIG. 1 are denoted by identical reference numerals and not explained again. In this embodiment, provision is made for an arrangement of two strings 2 of smaller springs 6 between two strings 1 of greater springs 5, whereby the strings 2 of smaller springs 6 are placed in staggered relationship. In this way, the intermediate space between the strings 1 of springs 5 is filled in an optimum manner by the smaller springs 6 of the strings 2. Of course, it is also conceivable to configure regions of the springs 5, 6 of the strings 1, 2 with different diameter and/or different convolution and/or different wire diameter.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. An innerspring assembly, comprising:

a first plurality of neighboring single pocketed first springs, each the first springs being defined by a diameter and connected to neighboring springs; and a second plurality of single pocketed second springs with at least one string of the second plurality of strings connected between neighboring strings of the first plurality of springs, wherein each of the second springs is defined by a diameter and a vertical dimension which is smaller than the diameter or the first springs, and wherein the second springs are so positioned between the neighboring first springs at a central horizontal axis of the first springs and corresponding central horizontal axis of the second springs that the second springs are suspended between the first springs and the second springs are interconnected to each other by bridges.

2. The innerspring assembly of claim 1, wherein the difference in vertical dimension between the first and second springs is approximately the same on both side of the spring.

3. The innerspring assembly of claim 1, wherein at least two strings of the second plurality of strings are placed between two strings of the first plurality of strings.

4. The innerspring assembly of claim 3, wherein the at least two strings of the second plurality of strings are placed in staggered relationship.

5. The innerspring assembly of claim 1, wherein the springs of at least one of the first and second plurality of strings have predetermined regions of different convolutions.

6. The innerspring assembly of claim 1, wherein the springs of at least one of the first and second plurality of strings have predetermined regions of different wire diameter.

7. The innerspring assembly of claim 1, wherein the first and second springs are barrel springs.

* * * * *

UNITED STATES PATENT AND TRADEMARK OFFICE

CERTIFICATE OF CORRECTION

PATENT NO. : 6,898,813 B2
DATED : May 31, 2005
INVENTOR(S) : Wolfgang Grothaus

It is certified that error appears in the above-identified patent and that said Letters Patent is hereby corrected as shown below:

Column 4,
Line 25, change “or” to -- of --;
Line 34, change “side” to -- ends --.

Signed and Sealed this

Fourth Day of October , 2005

JON W. DUDAS
*Director of the United States Patent and Trademark Office*